United States Patent [19]

Clegg

[11] Patent Number: 4,585,971

[45] Date of Patent: Apr. 29, 1986

[54] FLAT CIRCULAR FOIL-FILAMENT LAMP

[76] Inventor: John E. Clegg, 2320 Keystone Dr., Orlando, Fla. 32806

[21] Appl. No.: 682,959

[22] Filed: Dec. 18, 1984

[51] Int. Cl.[4] ..... H01J 1/15

[52] U.S. Cl. ..... 313/341; 313/343

[58] Field of Search ..... 313/341, 342, 343, 345

[56] References Cited

U.S. PATENT DOCUMENTS

| | | | |
|---|---|---|---|
| 671,725 | 4/1901 | Goddard | 313/342 |
| 1,305,295 | 6/1919 | McKay | 313/341 |
| 2,007,939 | 7/1935 | Braselton | 313/341 |
| 2,319,338 | 5/1943 | Mulder | 313/343 |
| 3,788,721 | 1/1974 | Vause | 313/315 |
| 4,144,473 | 3/1979 | Almer | 313/356 |

*Primary Examiner*—David K. Moore
*Assistant Examiner*—T. Salindong

[57] ABSTRACT

An incandescent electric lamp with a flat circular foil filament which emits a circular beam of maximum intensity in the direction perpendicular to the filament. The filament is mounted inside a ring conductor and has a reflective rear plate which returns heat to the filament as means of increasing the incandescence.Current flows from a center post conductor through the filament to a ring conductor.

1 Claim, 2 Drawing Figures

FLAT CIRCULAR FOIL-FILAMENT LAMP

BACKGROUND

The invention relates to electric incandescent lamps having flat foil filaments suspended between a center post conductor and a ring conductor.

Prior art includes U.S. Pat. No. 1,305,295 by McKay which features a flat circular foil filament mounted between grooved lead-in members on opposite sides of the filament, U.S. Pat. No. 2,319,338 by Mulder which features ring conductors supported by vertical post conductors, U.S. Pat. No. 617,725 by Goddard which features a grooved heat element with integral projections on the edges thereof, U.S. Pat. No. 3,788,721 of Vause featuring a metal web element, and U.S. Pat. No. 4,144,473 of Almer which features a hollow cylindrical filament with perforations.

SUMMARY

The invention is designed for use with a conical beam concentrator with a circular planar face perpendicular to the circular beam emitted by the foil filament of the lamp. The lamp and the concentrator are used together in a copending application of a Beam Ignitor which emits a concentrated beam into the combustion chamber of an internal combustion engine as means of igniting the compressed gases therein.

The patentable features of the invention are the perforated foil filament and the center post conductor and the ring conductor which serve as mounting means.

DRAWINGS

DESCRIPTION

Figure 1:
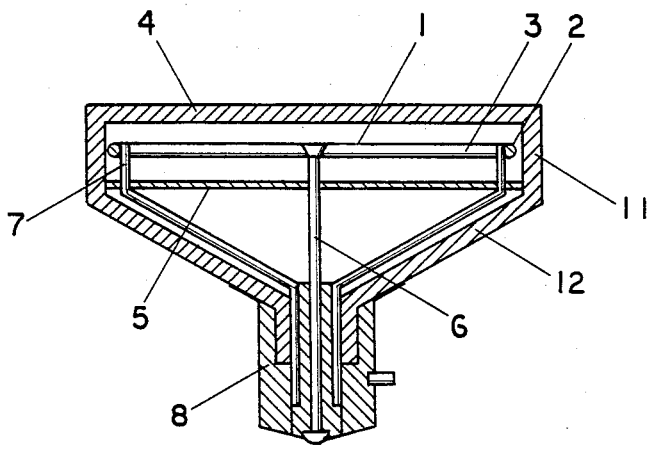
FIG. 1 is an elevation of the foil-filament lamp.
Figure 2:
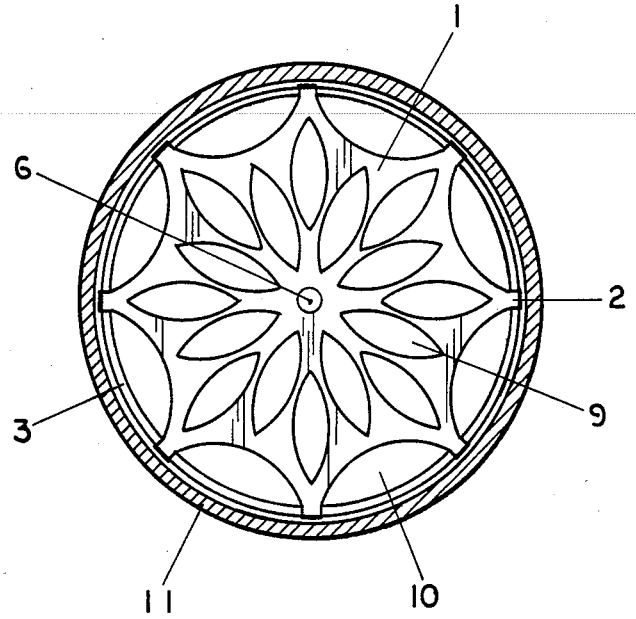
FIG. 2 is a plan view of the foil filament mounted inside the ring conductor.

FIG. 1 is an elevation of the flat circular foil-filament lamp with the planar circular perforated foil filament 1 suspended by mounting tabs 2 inside ring conductor 3 between front transparent bulb wall 4 and reflective rear plate 5. Current flows from a central post conductor 6 through filament 1 to ring conductor 3 to four peripheral post conductors 7 to bulb base 8.

Foil filament 1 is a foil of suitable high temperature metal which incandescences without melting. The filament is mounted in the horizontal plane of the bulb, and its center occupies the vertical axis of the bulb.

Sixteen arcuate perforations 9 are disposed in a circular pattern between the center and the perimeter of foil filament 1. Eight arcuate indentations 10 are located inside the circumference of the filament between mounting tabs 2. The purpose of the perforations 9 and indentations 10 is to permit an increase in the circumference of the filament without increasing the area thereof so that a wider beam can be emitted.

Foil filament 1 is supported in the central post conductor 6, which is a rigid straight steel rod mounted in bulb base 8 and occupying the vertical axis of the bulb, and around the circumference by mounting tabs 2, which are integral radial extensions of the filament. Mounting tabs 2 are curved around ring conductor 3, which is a rigid annular steel rod concentric to the filament.

The four peripheral post conductors 7 are rigid angular steel rods welded to the inside of ring conductor 3 as means of supporting the conductor. Peripheral post conductors 7 are mounted in bulb base 8 as shown in FIG. 1.

The reflective rear plate 5 is mounted on peripheral post conductors 7. The purpose of the reflective plate is to receive and return heat to the filament as means of increasing the incandescence of the filament. The rear plate also reflects light from the rear of the filament outward through the perforations 9 and indentations 10 and thereby increases the intensity of the beam emitted by the filament.

The bulb is a sealed evacuated glass chamber formed by front bulb wall 4, cylindrical ball 11, conical bulb wall 12, and bulb base 8.

I claim:

1. A flat circular foil-filament electric lamp comprising;

a planar circular foil filament (1) occupying a horizontal plane and having a center occupying a vertical axis of the lamp;

said foil filament (1) having a series of arcuate perforations (9) disposed in a circular pattern therein;

said foil filament (1) having eight arcuate indentations (10) spaced at equal intervals around the perimeter thereof;

said foil filament (1) having eight mounting tabs (2) comprising integral radial extensions thereof spaced at equal intervals around the perimeter thereof between said indentations (10);

a central post conductor (6) comprising a rigid straight steel rod occupying said vertical axis and serving as mounting means for the center of said foil filament (1);

said post conductor (6) serving as means through which an electric current is conducted to said foil filament (1);

a ring conductor (3) occupying said horizontal plane and comprising a rigid annular steel rod serving as a frame to which said foil filament (1) is mounted by said mounting tabs (2);

said ring conductor (3) serving as means through which an electric current is conducted from said foil filament (1);

four peripheral post conductors (7) comprising rigid angular steel rods spaced at equal intervals around said ring conductor (3) and welded thereto as to means of support thereof;

said peripheral post conductors (7) serving as means through which an electric current is conducted from said ring conductor (3);

a reflective rear plate (5) comprising an aluminized glass disk mounted on said peripheral post conductors (7) parallel to said foil filament (1) and serving as means by which light is received and reflected back to said foil filament (1);

a bulb base (8) comprising a sealed cylindrical ceramic member in which said central post conductor (6) and said peripheral post conductors (7) are mounted; and a bulb comprising a sealed evacuated glass chamber formed by a front bulb wall (4), a cylindrical bulb wall (11), a conical bulb wall (12), and said bulb base (8).

* * * * *